US005368443A

United States Patent [19]

Turkia et al.

[11] Patent Number: 5,368,443

[45] Date of Patent: Nov. 29, 1994

[54] BLADE WHEEL FOR A CENTRIFUGAL PUMP

[75] Inventors: Erkki Turkia, Inkeroinen; Matti Relander, Anjala, both of Finland

[73] Assignee: Tampella Forest Oy, Anjalankoski, Finland

[21] Appl. No.: 920,424

[22] PCT Filed: Feb. 20, 1991

[86] PCT No.: PCT/FI91/00053

§ 371 Date: Aug. 17, 1992

§ 102(e) Date: Aug. 17, 1992

[87] PCT Pub. No.: WO91/13259

PCT Pub. Date: Sep. 5, 1991

[30] Foreign Application Priority Data

Feb. 21, 1990 [FI] Finland ..... 900866

[51] Int. Cl.[5] ..... E04D 29/22

[52] U.S. Cl. ..... 416/184; 416/186 R; 416/183

[58] Field of Search ..... 416/179, 182, 183, 184, 416/185, 186 R, 188, 238

[56] References Cited

U.S. PATENT DOCUMENTS

| | | | |
|---|---|---|---|
| 1,613,816 | 1/1927 | Biggs . | |
| 2,405,283 | 8/1946 | Birmann | 416/183 |
| 3,953,150 | 4/1976 | Onal | 416/184 |
| 4,502,837 | 3/1985 | Blair et al. | 416/183 |

FOREIGN PATENT DOCUMENTS

| | | | |
|---|---|---|---|
| 27752 | 11/1955 | Finland . | |
| 53747 | 3/1978 | Finland . | |
| 13060 | 4/1881 | Germany . | |
| 2525316 | 12/1975 | Germany . | |
| 376640 | 6/1975 | Sweden . | |
| 672532 | 11/1989 | Switzerland . | |
| 992749 | 1/1983 | U.S.S.R. | 416/183 |
| 1132067 | 12/1984 | U.S.S.R. | 416/186 R |

OTHER PUBLICATIONS

G. Ekman, "The Pulp Industry–Some Difficult Pumping Tasks", Pumps, 1976, pp. 451–455.

*Primary Examiner*—Edward K. Look
*Assistant Examiner*—James A. Larson
*Attorney, Agent, or Firm*—Ladas & Parry

[57] ABSTRACT

A blade wheel for a centrifugal pump has at least two blade discs spaced along an axis of rotation of the discs. At least one row of generally radial blades extends between the blade discs and is spaced successively in a circumferential direction of the blade discs with blade ends radially outermost at peripheries of the blade discs. The blade ends are at an angle to the axis of the rotation of the discs, whereby each blade end has a leading edge and a trailing edge in the circumferential direction. In order to reduce pressure variations caused by the blades in a discharge conduit of the pump, the leading edge of the blade end of a trailing blade in the circumferential direction is one of in axial alignment with the trailing edge of the blade end of a successively leading blade in the circumferential direction and ahead of the trailing edge in the circumferential direction.

3 Claims, 1 Drawing Sheet

BLADE WHEEL FOR A CENTRIFUGAL PUMP

BACKGROUND OF THE INVENTION

The invention relates to a blade wheel for a centrifugal pump. The blade wheel has at least one row of generally radial blades successively in the circumferential direction of the blade wheel, the radially outermost blade ends being at an oblique angle $\alpha$ with respect to the direction of movement of the periphery of the blade wheel.

Centrifugal pumps are used widely for the transfer of liquid materials and mixtures. Their pumping effect is created by the rotation of a blade wheel in a fixed casing of the pump. The blade wheel subjects the material to be pumped to a centrifugal effect by rotational movement so that, when the material reaches a discharge opening, it is discharged into it under the influence of the centrifugal force and the motion of the blade ends. Such pumps are disclosed, e.g., in DE patent publication 2,525,316 and FI patent 53,747.

A problem with pumps known from the prior art is the pulse-like pressure variation occurring in their discharge conduits, which is disadvantageous under certain operating conditions. In particular, when the pump is used as a feed pump for fibre suspension in the conduit system associated with the head box of a paper machine or the like, the pressure variations cause wave-like variations in the forming paper or cardboard web, thus deteriorating the quality. In an attempt to decrease the pulse, the radially outermost ends of the blades of the blade wheel of a pump have been made oblique in the circumferential direction of the blade wheel, but this has not eliminated the pulse disturbances.

SUMMARY OF THE INVENTION

The object of the present invention is to provide a blade wheel by means of which the output pressure pulse disturbances can be decreased, whereby it will be more suitable for use in the feed pumps for head boxes of paper machines, for instance.

The blade wheel of the invention is characterized in that a circumferential distance between the blades, the axial length of the blades and the angle of the blades in the circumferential direction are such that the leading edge of the trailing blade is in axial alignment with the trailing edge of the leading blade in the circumferential or movement direction, or ahead of said trailing edge in said circumferential direction of movement.

An essential feature of the invention is that the blades of the blade wheel are disposed at such intervals and at such an angle that, when the blade wheel rotates, at least one blade end is always passing by a nose of a discharge conduit of a spiral pump casing for the blade wheel. As a result, the pressure pulse created by the blade end at the nose remains substantially constant all the time, and no appreciable pressure variation occurs in the discharge conduit.

BRIEF DESCRIPTION OF THE DRAWINGS

The invention will be described In greater detail with reference to the attached drawings, in which.

DESCRIPTION OF EMBODIMENTS

Figure 1:
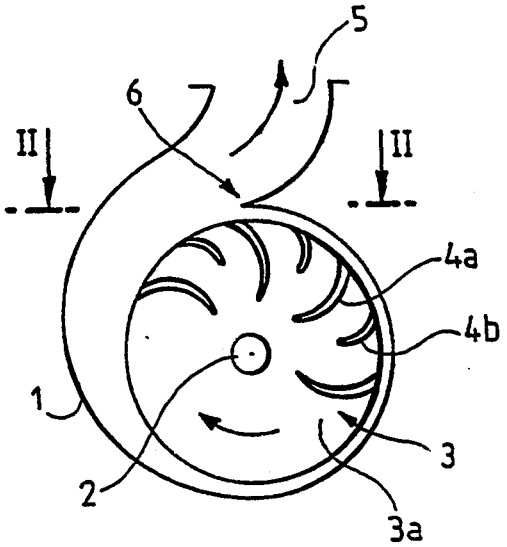
FIG. 1 is a schematic axial sectional view on section I—I of FIG. 2 of a centrifugal pump provided with a blade wheel according to the invention.

FIG. 1 shows a centrifugal pump comprising a spiral pump casing 1 within which a blade wheel 3 rotates around the axis of a shaft 2 in the clockwise direction indicated by the arrow. The blade wheel has generally radial blades 4*a* and 4*b* successively around its circumference and generally axially between axially opposite-edge discs 3*a* (only one shown in FIG. 1). The pump casing 1 has a discharge conduit 5 having a nose 6 at the edge of the discharge conduit on the side of the casing that is closer to the blade wheel.

Material to be pumped, such as a liquid or a suspension, enters the pump casing in a manner known per se and, therefore, not shown in the direction of the pump shaft 2 and at the centre of the blade wheel. When the blade wheel rotates, the material is passed from its entrance into the discharge conduit by the suction effect of the material already discharged into the discharge conduit, by the push effect produced by the radially outermost ends of the blades of the blade wheel 3, and by centrifugal force on the spiral of the casing into the discharge conduit 5.

The vanes or blades 4*a* of the blade wheel are of conventional radial length and extend from the periphery of the blade wheel closer to the pump shaft 2 than the blades 4*b*, which are shorter and serve as a kind of auxiliary blade. The purpose of the shorter auxiliary blades 4*b* is to make the radial flow paths from the central material-entrance portion of the blade wheel 3 wider than they would be if all the blades reached the central portion of the blade wheel. This facilitates the flow of the mass of the material to the peripheral blade ends while keeping the blade ends sufficiently dense (i.e., numerous per circumferential length unit) circumferentially along the outer periphery of the blade wheel 3.

In other respects, the structure, operation and dimensions of the centrifugal pump are obvious to one skilled in the art and will not be described more fully here.

Figure 2:
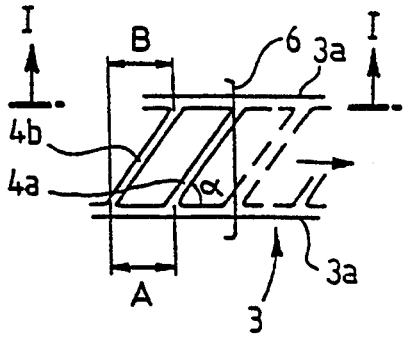
FIG. 2 is a partial sectional schematic top plan view of the blade wheel and a nose of FIG. 1 showing the edge of the blade wheel and the radially outermost ends of the blades thereof.

FIG. 2 shows schematically a portion of the edge of the blade wheel 3 of FIG. 1 with its radially outermost blade ends and a portion of the nose 6 of the discharge conduit. FIG. 2 shows that the ends of the blades 4*a* and 4*b* are disposed at an oblique angle $\alpha$ to a circumferential direction normal to the rotation axis of the shaft 2 (FIG. 1) for the blade wheel and, thus, to the tangential direction of movement of the blade ends shown by the arrow in FIG. 2. The angle $\alpha$ and the axial length of the blades between the discs 3*a* are such that one leading or trailing edge of the blade 4*a* and the opposite trailing or leading edge of the blade 4*b* are in axial alignment or partly overlap in the circumferential direction. That is, a circumferential distance A between the same edges (trailing edges as shown in FIG. 2) of circumferentially successive blades is equal to or, in another embodiment (not shown), smaller than a circumferential distance B between axially opposite ends of the same blade. When the blade wheel 3 then rotates in the direction indicated by the arrow shown in FIG. 2, there is always one or more blade ends at the nose 6. Preferably, the number of blade ends at the nose remains the same all the time throughout the rotation of the blade wheel, i.e. all around the circumference of the blade wheel.

As a result, the pressure pulse created at the nose by the movement of the blade ends thereby remains substantially constant even though its location varies to some extent in the axial direction of the blade wheel. This, however, does not substantially affect the pressure pulse or pressure pattern occurring in the discharge conduit 5.

Figure 3:
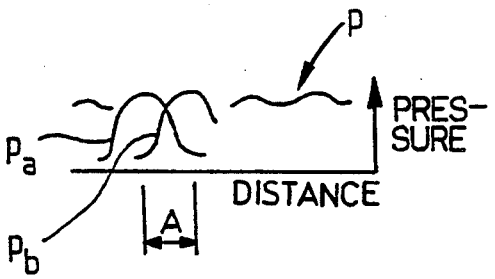
FIG. 3 is a schematic diagram of pressure variation along a discharge conduit of the pump of FIG. 1.

FIG. 3 illustrates schematically the pressure occurring along the discharge conduit 5 of the centrifugal pump of FIGS. 1 and 2. The pressure pattern is slightly wave-like, as shown by the continuous wavy line P. The figure further shows two wave-like pulses Pa and Pb, which represent the pulse pattern created by successive blades 4*a*, 4*b*. These pressure pulses sum, however, so that the pressure curve P is achieved in which pressure variation is substantially negligible.

Figure 4:
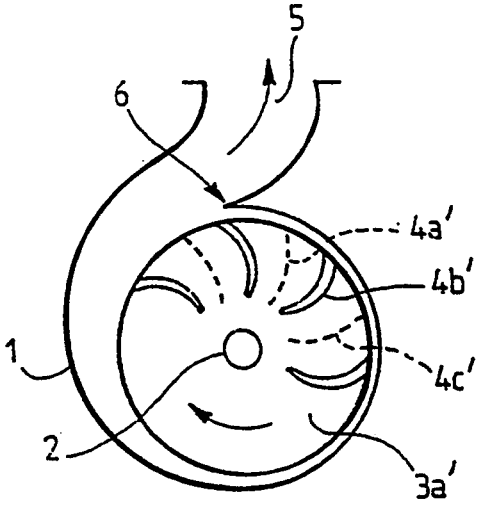
FIG. 4 is a schematic axial sectional view on section IV—IV of FIG. 5 of another centrifugal pump provided with another, two-sided blade wheel according to the invention.

FIG. 4 illustrates the principle of FIGS. 1 and 2 when applied to a two-sided blade wheel In this case, the blades 4*a*', 4*b*', 4*c*' all have the full radial length of blades 4*a* in FIG. 1 and are positioned alternately on opposite sides of a central flange or disc 3*b* of the blade wheel.

In another embodiment (not shown) there can be radially shorter blades similar to blades 4*b* shown in FIG. 1. The full-length blades then can be positioned axially beside each other, or they may alternate in such a way that the shorter auxiliary blade of one blade row is positioned axially beside the full-length blade of the other blade row.

Figure 5:
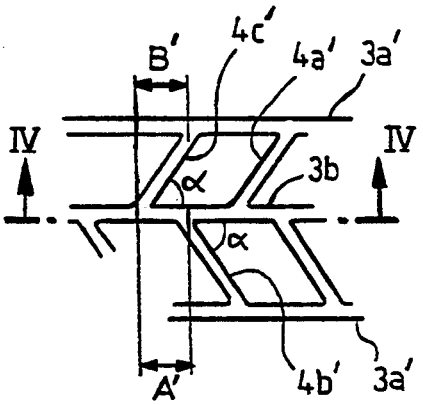
FIG. 5 is a partial schematic top plan view of the blade wheel of FIG. 4.

FIG. 5 shows schematically a portion of the edge of the blade wheel of FIG. 4 and, therefore, the radially outermost ends of the blades. In this case, the blades 4*a*' to 4*c*$^1$ are positioned in alternating rows at opposite angles $\alpha$ relative to the central flange 3*b*.

The embodiment of FIGS. 4 and 5 concerning the two-sided blade wheel is a pump in which the material or mass to be pumped enters the pump on opposite sides of the central flange in the direction of the shaft and at the centre of the blade wheel and is then passed on into a common discharge conduit 5. As shown in FIG. 5, the leading edges of the adjacent blade rows 4*a*', 4*c*' and 4*b*' in the direction of movement (FIG. 4) are on the axially outer edges of the blade wheel, while the trailing edges in the direction of movement are at the central flange 3*b*.

As in the embodiment of FIG. 2, the blades 4*a*' 4*c*' and 4*b*' are sufficiently long from the central flange 3*b* to the opposite discs 3*a*' relative to the angle $\alpha$ that the leading edge of the blade end of each of the blades 4*a*', 4*c*' of one row of the blades is in axial alignment with the trailing edge of the blade end of one of the blades 4*b*' of the second row of the blades so that the number of blades, i.e. blade ends, at the nose 6 is always the same and the pressure variation is minimized.

The invention has been described above and in the drawings schematically and by way of examples, but is in no way restricted to these. In place of blades of different lengths, it is possible to use blades of equal length while the number or density of the blades may be chosen to achieve the desired evenness of the pressure. Similarly, the curvature and the obliqueness of the blades may vary over the length of the blades, provided that the above-mentioned principle is observed at the ends of the blades.

We claim:

1. A blade wheel for a centrifugal pump, the blade wheel comprising at least two blade discs spaced along an axis of rotation of the discs, at least one row of generally radial blades extending between the blade discs and spaced successively in a circumferential direction of the blade discs with blade ends radially outermost at peripheries of the blade discs, the blade ends being at an angle to the axis of rotation of the discs, whereby each blade end has a leading edge and a trailing edge in the circumferential direction, wherein in order to reduce pressure variations caused by the blades in a discharge conduit of the pump, the leading edge of the blade end of a trailing blade in the circumferential direction is one of in axial alignment with the trailing edge of the blade end of a successively leading blade in the circumferential direction and ahead of the trailing edge in the circumferential direction.

2. The blade wheel according to claim 1, wherein the leading edge of the blade end of the trailing blade is substantially in axial alignment with the trailing edge of the leading blade.

3. A blade wheel for a centrifugal pump, the blade wheel comprising at least two blade discs spaced along an axis of rotation of the discs, at least one row of generally radial blades extending between two of the blade discs and spaced in a circumferential direction of the blade discs with blade ends radially outermost at peripheries of the blade discs, the blade ends being at an angle to the axis of rotation of the discs, whereby each blade end has a leading edge and a trailing edge in the circumferential direction, and further comprising a second row of the blades axially adjacent the one row, the leading edge of the blade end of each of the blades (4*a*', 4*c*') of the one row of the blades being in axial alignment with the trailing edge of the blade end of one of the blades (4*b*') of the second row of the blades.

* * * * *